US011701695B2

(12) United States Patent
Klöckner

(10) Patent No.: US 11,701,695 B2
(45) Date of Patent: Jul. 18, 2023

(54) METHOD FOR OPERATING A ROLL STAND FOR STEPPED ROLLING

(71) Applicant: SMS group GmbH, Düsseldorf (DE)

(72) Inventor: Jürgen Klöckner, Netphen (DE)

(73) Assignee: SMS group GmbH, Düsseldorf (DE)

( * ) Notice: Subject to any disclaimer, the term of this patent is extended or adjusted under 35 U.S.C. 154(b) by 130 days.

(21) Appl. No.: 17/299,820

(22) PCT Filed: Dec. 2, 2019

(86) PCT No.: PCT/EP2019/083331

§ 371 (c)(1),
(2) Date: Jun. 4, 2021

(87) PCT Pub. No.: WO2020/114976

PCT Pub. Date: Jun. 11, 2020

(65) Prior Publication Data

US 2021/0316347 A1 Oct. 14, 2021

(30) Foreign Application Priority Data

Dec. 6, 2018 (DE) ..... 10 2018 221 153.1
Feb. 19, 2019 (DE) ..... 10 2019 202 237.5
Oct. 2, 2019 (DE) ..... 10 2019 215 265.1

(51) Int. Cl.
*B21B 37/54* (2006.01)
*B21B 39/08* (2006.01)

(52) U.S. Cl.
CPC ..... *B21B 37/54* (2013.01); *B21B 39/084* (2013.01)

(58) Field of Classification Search
CPC ..... B21B 37/48; B21B 37/52; B21B 37/54; B21B 39/084; B21B 39/08; B21B 39/02
See application file for complete search history.

(56) References Cited

U.S. PATENT DOCUMENTS

2007/0261456 A1 11/2007 Jepsen et al.
2017/0239700 A1 8/2017 Mueller

FOREIGN PATENT DOCUMENTS

DE 102004041321 A1 3/2006
EP 1454681 A2 9/2004
EP 1908534 B1 10/2008
EP 1121990 B2 2/2012
EP 3210681 B1 1/2020

*Primary Examiner* — Teresa M Ekiert
(74) *Attorney, Agent, or Firm* — Smartpat PLC

(57) ABSTRACT

A method for operating a roll stand for the stepped rolling of metal strip is described. The metal strip is initially fed into a roll stand on the infeed side, where it is step-rolled. This creates a leading and a trailing section of the metal strip, each with different thicknesses. After the roll stand, the step-rolled metal strip initially passes through an outfeed-side strip accumulator before it is wound into a coil by an upcoiler. The outfeed-side reel is controlled to a constant strip tension. To keep the outfeed-side strip tension sufficiently constant even in the case of rapid changes in the size of the roll gap and the resulting rapid changes in thickness in the rolled metal strip the control of the strip tension with the aid of the upcoiler is supplemented by a position control for a roller unit in the outfeed-side strip accumulator.

6 Claims, 1 Drawing Sheet

METHOD FOR OPERATING A ROLL STAND FOR STEPPED ROLLING

CROSS-REFERENCE TO RELATED APPLICATION

This application is a national stage application, filed under 35 U.S.C. § 371, of International Patent Application No. PCT/EP2019/083331, filed on Dec. 2, 2019, which claims the benefit of German Patent Application No. 10 2018 221 153.1, filed Dec. 6, 2018, of German Patent Application No. 10 2019 202 237.5, filed Feb. 19, 2019, and of German Patent Application No. 10 2019 215 265.1, filed Oct. 2, 2019.

TECHNICAL FIELD

The disclosure relates to a method for operating a roll stand for the stepped rolling of metal strip. The term "stepped rolling" refers to the rolling of a metal strip with different thicknesses in individual sections of the metal strip.

BACKGROUND

Methods for the stepped rolling of metal strip are known in principle in the prior art, for example from the European patent application EP 1 121 990 A2. This patent application discloses a roll stand with work rolls that span a roll gap. A drag reel and a strip accumulator are arranged upstream of the roll stand on the infeed side for feeding metal strip with a constant initial thickness into the roll stand. On the outfeed side, a strip accumulator and an upcoiler are arranged downstream of the mill stand—viewed in the direction of material flow. In particular, the upcoiler is controlled to the average value of the outfeed speed of the metal strip from the roll stand, taking into account the respectively changed coil diameter. In this manner, on average as much strip is wound onto the upcoil reel as strip leaves the roll gap. The at least one roller unit in the outfeed-side strip accumulator, which is for example a dancer roll, is force-controlled such that there is a desired strip tension.

Such function of the outfeed-side strip accumulator as an actuator for controlling the outfeed-side strip tension has the disadvantage that the position of the roller unit or the dancer roll, as the case may be, is, in principle, undetermined due to the specified force control. This indeterminacy of the position of the roller unit, in conjunction with the fast-moving metal strip, leads to instabilities. This is true because the strip accumulator in particular can be regarded as a spring-mass system during its operation, possibly also in conjunction with the upcoiler, which tends to oscillate uncontrollably when operated in the range of its resonant frequency. As a result, it can be seen that the desired control of the strip tension on the outfeed side with the aid of the outfeed-side strip accumulator as a force-controlled actuator functions only suboptimally.

Furthermore, it is known in the prior art to control the outfeed-side strip tension of the metal strip with the aid of the upcoiler as an actuator to a predetermined outfeed-side target strip tension.

The latter control works sufficiently well as long as rolling is carried out at low rolling speeds and, in particular, differences in thickness between individual sections of the metal strip are introduced into the metal strip only by slow changes in the roll gap.

However, if such changes in the roll gap and the associated differences in thickness in the metal strip occur relatively quickly, such control is not suitable. The metal strip wound into a coil by the upcoiler typically weighs several tons, for example 25 tons. Therefore, the inertia of the outfeed-side upcoiler, in particular when loaded with the specified coil, is too large to compensate for rapid changes in the thickness of the metal strip with respect to a constant strip tension.

SUMMARY

The disclosure is based on the object of further improving a known method for operating a roll stand for the stepped rolling of metal strip in such a manner that the outfeed-side strip tension can be kept sufficiently constant even in the case of rapid changes in the size of the roll gap and the resulting rapid changes in thickness in the rolled metal strip.

This object is achieved by the method as claimed. Accordingly, the outfeed-side strip tension of the metal strip is controlled with the aid of the upcoiler as an actuator to a predetermined target strip tension and in addition—superimposed—the position of the at least one roller unit of the outfeed-side strip accumulator is controlled to individually predetermined target positions $P_{Soll\ v}$, $P_{Soll\ n}$ for the respective leading and trailing sections of the metal strip. ($P_{Soll\ v}$, =target position, leading; $P_{Soll\ n}$=target position, trailing).

The term "stepped rolling" means the rolling of a continuous metal strip with different thicknesses in individual sections. In particular, the thickness in a trailing section of the metal strip is different from that in a leading section of the metal strip adjacent thereto. The difference between the thicknesses is Δh. Instead of the term "stepped rolling", the term "flexible rolling" is also used synonymously.

The control of the strip tension with the aid of the upcoiler as an actuator forms the basis for keeping the outfeed-side strip tension constant. This control is well suited for keeping the strip tension constant if the thickness of the metal strip does not change or changes only comparatively slowly at the outfeed of the roll stand. In this connection, "comparatively slowly" means so slow that a resulting change in the strip tension can be compensated for with the upcoiler despite its high inertia. However, in order to also be able to control or compensate for, as the case may be, quasi-superimposed rapid changes in the strip tension, a position control of the roller unit in the outfeed-side strip accumulator is superimposed on the specified control of the strip tension with the aid of the upcoiler. The roller unit in the outfeed-side strip accumulator has a much lower mass inertia than the upcoiler and can therefore react very flexibly, i.e. very quickly, to higher-frequency changes in strip tension, such as those resulting from rapid changes in the thickness of the metal strip. In contrast to the force control of the roller unit known from the prior art, the claimed position control of the roller unit of the outfeed-side strip accumulator offers the advantage that the position of the roller unit is set to a fixed value in the form of target positions in each case during the control. With this fixed setting of the target positions, the respective strip tension is also fixed. Unlike force control of the roller unit, the position control of the roller unit offers the advantage of greater stability of the outfeed-side strip tension even with dynamic changes in the roll gap or the thickness, as the case may be, of the metal strip.

In accordance with one embodiment, the necessary change in the target position of the roller unit resulting from the predetermined difference in thickness is calculated in advance in terms of time in a process model for the stepped rolling, preferably before or while the difference in thickness is realized by a change in the roll gap between the work rolls of the roll stand. In the case of this precalculation, the roller unit can be adjusted or pre-controlled, as the case may be, to its new changed target position at a very early stage. This is preferably takes place at the latest when the size of the roll gap is changed by the difference in thickness Δh. This pre-control offers the advantage that the required change in the position of the roller unit does not occur later in time than the change in thickness, by which an otherwise temporarily occurring instability of the strip tension can be effectively prevented.

The metal strip fed to the roll stand on the infeed side preferably has a constant initial thickness.

Further advantageous embodiments of the method concerning both the infeed side and the outfeed side of the roll stand are the subject of the dependent claims.

DETAILED DESCRIPTION

The invention is described in detail below with reference to the specified figures in the form of exemplary embodiments. In all figures, the same technical elements are designated with the same reference signs.

Figure 1:
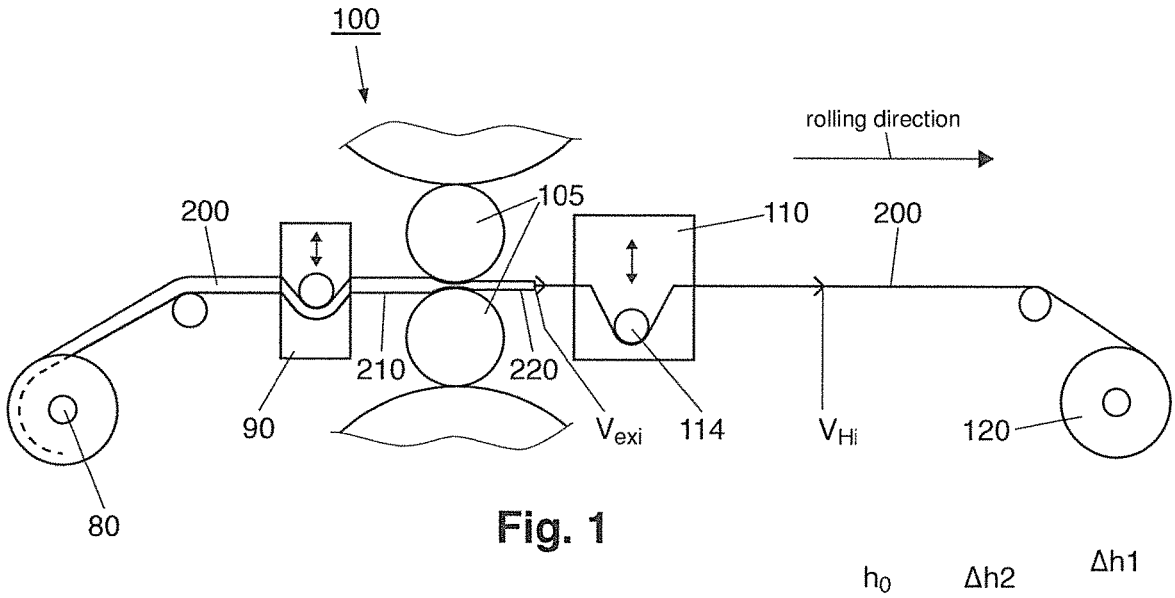
FIG. 1 shows a rolling mill with a roll stand for the stepped rolling of metal strip.

FIG. 1 shows a rolling mill for the stepped rolling of metal strip 200. This mill includes a roll stand 100 with work rolls 105, which span a roll gap. The size of the roll gap is variable in stepped rolling for introducing differences in thickness Δh into the metal strip. As a consequence, a leading section 220 of the metal strip then has a different thickness than a trailing section 210 of the metal strip 200. The difference in thickness is Δhi; see FIG. 2. Thereby, the running parameter i with i=1 . . . I denotes a respective section of the metal strip.

In accordance with FIG. 1, the metal strip with a preferably constant initial thickness $h_0$ is provided by a drag reel 80 on the infeed side of the roll stand 100. It then optionally passes through an infeed-side strip accumulator 90 before it enters the roll gap between the work rolls 105 of the roll stand and is rolled there. On the outfeed side, the metal strip 200 that is then rolled initially passes through an outfeed-side strip accumulator 110 before being wound into a coil by means of an outfeed-side upcoiler.

Due to changes in the size of the roll gap during rolling, the metal strip wound into the coil has different thicknesses in different sections.

The method for operating the roll stand 100 is described in detail below with reference to the figures. The method applies in particular to the cold rolling of metal strip; however, application of the method to hot strip is not excluded.

The method is aimed in particular at keeping the strip tension on the outfeed side of the roll stand 100 constant even in the case of rapid changes in the thickness of the metal strip, such as those that occur during stepped rolling. For this purpose, the upcoiler 120 is used as an actuator for a strip tension control system, with which the outfeed-side strip tension is controlled to a predetermined outfeed-side target strip tension.

At a constant cross-section of the metal strip, the strip tension is proportional to a tensile force acting on the metal strip in the longitudinal direction of the metal strip. The control to the constant target strip tension can be realized, for example, by changing the target torque of the upcoiler in a manner dependent on time according to the continuously increasing radius of the coil during winding. In this respect, the claimed control of a constant target strip tension on the outfeed side can be realized by a suitable control of the torque of the upcoiler, wherein the target torque to be provided must then be changed as a function of the coil radius, which changes over time. The specified control to the constant strip tension corresponds to a control to an average value of the speed of the metal strip at the exit of the roll stand.

In order to also be able to control rapid changes in the roll gap and resulting rapid changes in the thickness of the metal strip with regard to a desired constant strip tension, as described above, a rapid position control for the roller unit 114 of the outfeed-side strip accumulator 110 is superimposed on the specified control of the strip tension by means of the upcoiler. Such position control provides that, for each section i of the metal strip with a different or individual thickness, as the case may be, the roller unit in the outfeed-side strip accumulator is controlled to an individually predetermined target position. The necessity for setting such individual target positions for the sections of the metal strip of different thicknesses is explained in more detail below, in particular with reference to FIG. 2.

Figure 2:
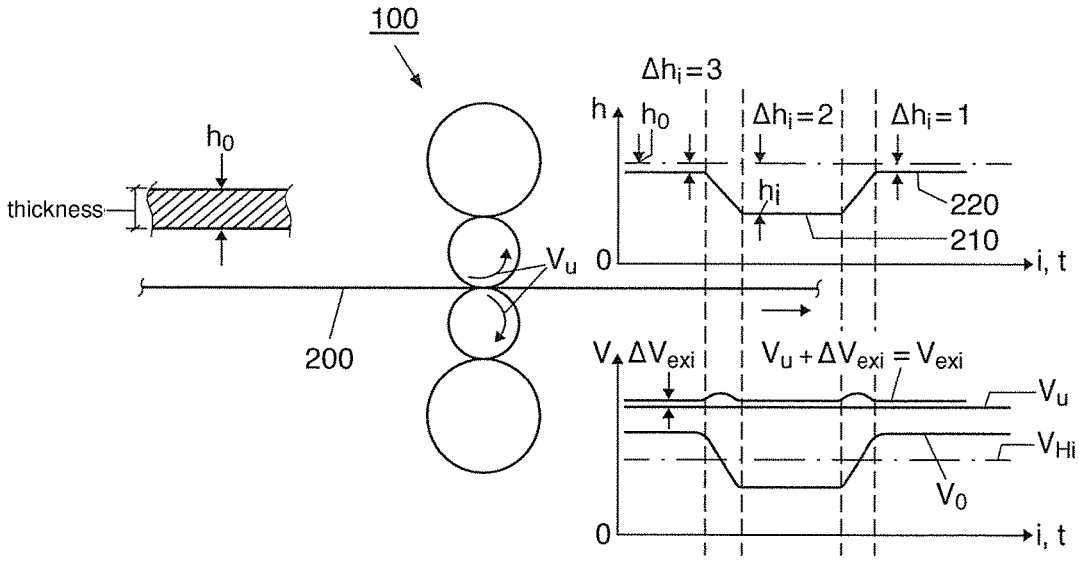
FIG. 2 shows a detailed view of FIG. 1 to explain the method for operating a roll stand.

It is assumed that the metal strip 200 enters the roll gap between the work rolls 105 of the roll stand 100 with an initial thickness $h_0$. In the roll gap, the metal strip 200 initially undergoes a thickness reduction by a difference in thickness Δhi, as shown in FIG. 2. This thickness reduction Ahi of the metal strip on the outfeed side of the roll stand 100 leads to a change in the outfeed speed Vex i of the metal strip from the roll stand by an amount ΔVex i in the leading section 220 of the metal strip, in particular compared to the circumferential speed VU of the work rolls 105 of the roll stand 100, which is simplistically assumed to be constant.

The change in the output speed ΔVex i depends on a large number of parameters, as they are not exhaustively listed in the following physical function.

ΔVi=f (ho, Δhi, η: coefficient of friction in the roll gap, kf: flow curve of the material to be rolled, roughness, diameter and circumferential speed VU of the work rolls, degree of lubrication in the roll gap, temperature, roughness of the metal strip, tensile force FZug i on metal strip at the exit of the roll stand before the outfeed-side strip accumulator, tensile force Fzug Hi on the metal strip at the exit of the outfeed-side strip accumulator, etc).

The change in output speed ΔVex i is typically predicted by a process model based on initialized values for the individual parameters. The initialized values are often only estimates or empirical values because the values of many of the parameters are not exactly known or reproducible. During the execution of the rolling process, it is therefore recommended to observe the individual parameters with the aid of an observer, that is, to record them metrologically and to compare their observed or measured values with the values currently used in the process model. In the event of a detected deviation of individual parameter values, it is then recommended to adjust the process model in order to continuously improve it.

The total speed Vex i of the metal strip at the outfeed of the roll stand in the transport direction of the metal strip in front of the outfeed-side strip accumulator 110 is calculated as follows:

$$Vex\ i = VU + \Delta Vex\ i$$

To be distinguished from this is the speed of the metal strip VHi at the outfeed of the outfeed-side strip accumulator 110 or the infeed of the upcoiler 120.

By integrating the difference in speed Vex i-VHi over time, the change in length Δs i of the metal strip on the outfeed side of the roll stand resulting from the original change in thickness Δhi can be calculated in accordance with the following formula:

$$\Delta s\ i = \int (Vex\ i - VHi)dt$$

Figure 3:
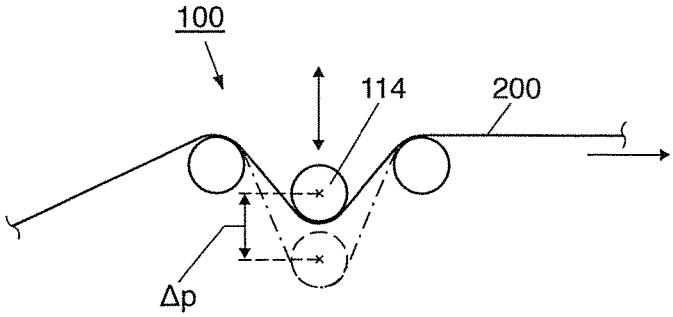
FIG. 3 shows an illustration of the changed target position of the roller unit in the outfeed-side strip accumulator.

Such change in length Δs i must be compensated for in the outfeed-side strip accumulator 110 so that the change in length has no negative influence on the constancy of the strip tension on the outfeed side of the roll stand. For this purpose, the present disclosure provides for calculating from this calculated change in length Δsi a required change in the target position Δpi of the roller unit in the outfeed-side strip accumulator 110 in such a manner that the specified change in length Δs in the strip accumulator is preferably fully compensated for. FIG. 3 shows an example of the change in the target position Δpi of the roller unit. The specified change in the target position Δpi corresponds, as an example, in rough approximation to half of the change in length Δsi of the metal strip, wherein, however, angular relationships and the length sections of the metal strip guided in the outfeed-side strip accumulator must also be taken into account. The change in the target position Δp i of the roller unit is carried out within the scope of a position control or position regulation, which is superimposed on the traditional strip tension control of the metal strip on the outfeed side of the roll stand.

The roller unit only has a much lower mass and inertia compared to the upcoiler, in particular if the latter carries the metal strip wound into a coil. Therefore, the roller unit or strip accumulator, as the case may be, can advantageously react much faster to rapid changes in the length of the metal strip, such as those that occur in particular during stepped rolling, than the much more sluggish upcoiler. Changes in length are proportional to changes in strip tension in accordance with the following proportionality relationship:

$$\Delta F_{Zug} i = \Delta si \cdot \left(\frac{E \cdot A}{L}\right)$$

with $\Delta F_{Zug}$ Change in the strip tension

Δs Change in length of the metal strip due to a change in thickness of the metal strip E E-modulus of the metal strip A Cross-sectional area of the metal strip L Stretched length of the metal strip.

While the outfeed-side upcoiler 120, due to its inertia, winds the metal strip 200 essentially at a constant circumferential speed VHi, which corresponds to an average outfeed speed of the metal strip from the roll stand 100 even with changed thicknesses, the position-controlled strip accumulator compensates for the fluctuations of the outfeed-side strip speed Vex i around the specified average value VHi shown in FIG. 2. In this manner, the object to keep the outfeed-side strip tension constant even in the case of highly dynamic changes in the roll gap and thus in the thickness of the outfeed-side strip, is ensured.

LIST OF REFERENCE SIGNS

80 Drag reel on the infeed side
90 Infeed-side strip accumulator
100 Rolling mill
105 Work rolls of the roll stand
110 Outfeed-side strip accumulator
114 Roller unit
120 Upcoiler
200 Metal strip
210 Trailing metal strip section
220 Leading metal strip section
Δhi Difference in thickness between the leading and trailing sections of the metal strip
Δsi Change in the target position of the roller unit of the strip accumulator
Δvi Change in the outfeed speed of the metal strip from the roll stand due to the difference in thickness Δh
$P_{Soll\ v}$ Target position of the leading section of the metal strip
$P_{Soll\ n}$ Target position of the trailing section of the metal strip
I or v (Leading) section of the metal strip
i+1 or n (Lagging) section of the metal strip
Vo Speed of the metal strip at the entrance of the roll stand
Vex i Speed of the metal strip at the outfeed of the roll stand in front of the strip accumulator on the outfeed side
VHi Speed of the metal strip behind the outfeed-side strip accumulator at the infeed of the upcoiler.
VU Circumferential speed of the work rolls

The invention claimed is:

1. A method for operating a roll stand (100) during stepped rolling of a metal strip (200), wherein an outfeed-side strip accumulator (110) with at least one roller unit (114) and an upcoiler (120) are arranged downstream of the roll stand, the method comprising:

feeding the metal strip (200) into the roll stand (100) on an infeed side;

stepped rolling of the metal strip in the roll stand (100) such that a leading and a trailing section (220, 210) of the metal strip have different thicknesses with a difference in thickness (Ahi);

passing the metal strip (200) through the outfeed-side strip accumulator (110); and coiling of the metal strip having the different thicknesses downstream of the strip accumulator (110) into a coil by the upcoiler (120);

controlling a position of the roller unit (114) of the outfeed-side strip accumulator (110) to individually predetermined target positions (Psoll v, Psoll n) respectively for the leading and the trailing section of the metal strip (200); and controlling an outfeed-side strip tension of the metal strip (200) with the upcoiler (120) as an actuator to a predetermined outfeed-side target strip tension.

2. The method according to claim 1, wherein the target position (Psoll n with n=i+1) predetermined for the trailing section (210) of the metal strip (200) is calculated from the target position (Psoll v with v=i) predetermined for the leading section (220) of the metal strip as $$Psoll\ n = Psoll\ v + \Delta p,$$

wherein a change in target position (Δp) is determined by calculating a change in the outfeed speed (ΔVexi) of the metal strip from the roll stand in accordance with the difference in thickness (Ahi); and integrating the difference in speed (Vex i−Vhi) of the metal strip over time into a resulting change in length (Δsi) of the metal strip (200) on the outfeed side of the roll stand (100); and calculating the change in the target position (Δp) of the roller unit (114) in the strip accumulator to compensate for the change in length (Δsi) of the metal strip during a transition from the leading to the trailing section (220, 210).

3. The method according to claim 2, wherein the necessary change in the target position (Δp) of the roller unit (114) resulting from the difference in thickness (Δhi) is calculated in advance in terms of time in a process model for the stepped rolling, before or while the difference in thickness (Δhi) is realized by a change in a roll gap between work rolls (105) of the roll stand, and wherein the roller unit (114) is adjusted to its new changed target position (Psoll n with n=i+1) and in this respect is pre-controlled before a size of the roll gap is changed by the difference in thickness (Δhi).

4. The method according to claim 1, wherein a drag reel (80) for providing the metal strip is arranged on the infeed side of the roll stand (100), and wherein at least one infeed-side strip accumulator (90) for the metal strip is arranged between the drag reel and the roll stand, wherein the method further comprises the following steps:

controlling a rotational speed of the drag reel (80) to a predetermined winding target speed; and controlling an infeed-side strip tension of the metal strip (200) to a predetermined infeed-side target strip tension with the infeed-side strip accumulator (90) as an actuator.

5. The method according to claim 1, wherein the metal strip (200) fed into the roll stand (100) on the infeed side has a constant initial thickness (h0).

6. The method according to claim 1, wherein the metal strip is cold-rolled during the stepped rolling.

* * * * *